United States Patent [19]

Scott et al.

[11] Patent Number: 4,696,344

[45] Date of Patent: Sep. 29, 1987

[54] ANNULUS PRESSURE OPERATED RATCHET DEVICE

[75] Inventors: Theron A. Scott, Odessa, Tex.; Robert T. Evans, Duncan, Okla.

[73] Assignee: Halliburton Company, Duncan, Okla.

[21] Appl. No.: 801,898

[22] Filed: Nov. 25, 1985

[51] Int. Cl.[4] ..... E21B 33/126

[52] U.S. Cl. ..... 166/182; 166/202

[58] Field of Search ..... 166/179, 182, 121, 125, 166/202

[56] References Cited

U.S. PATENT DOCUMENTS

| | | | |
|---|---|---|---|
| 2,698,663 | 1/1955 | Brown | 166/121 |
| 2,719,587 | 10/1955 | Brown | 166/121 |
| 3,670,815 | 6/1972 | Brown | 166/202 |
| 4,397,351 | 8/1983 | Harris | 166/182 |
| 4,437,516 | 3/1984 | Cockrell | 166/182 |
| 4,526,229 | 7/1985 | Dickerson | 166/182 |

*Primary Examiner*—Stephen J. Novosad
*Assistant Examiner*—William P. Neuder
*Attorney, Agent, or Firm*—James R. Duzan

[57] ABSTRACT

An annulus pressure operated ratchet device for use in a well bore. A mandrel includes an upwardly-directed elastomeric cup which is slidingly received over the mandrel. A sleeve is slidingly received over the mandrel beneath the cup and a ratchet disposed between the sleeve and the mandrel permits only downward movement of the sleeve. An elastomeric packer is received about the mandrel between the sleeve and an upwardly-directed shoulder. Annulus pressure urges the cup and sleeve downwardly to compress the packer thereby sealingly engaging it with the casing. The shoulder beneath the packer is threadably engaged with the mandrel by a left-hand thread. Right-hand mandrel rotation unthreads the connection thereby releasing the packer.

8 Claims, 2 Drawing Figures

ANNULUS PRESSURE OPERATED RATCHET DEVICE

BACKGROUND OF THE INVENTION

The instant invention relates generally to an annulus pressure operated ratchet device and more particularly, but not by way of limitation, to such a device which is used to set a packer in a well bore.

Sometimes it may be desirable to set a packer in a well bore without the use of metal slips which include teeth that engage the well bore in order to effect packer setting. For example, sometimes a portion of the original metal casing in a well bore may become corroded to the point where there is fluid communication between the bore and the adjacent zone as a result of the corrosion. In such cases it may be necessary to repair the casing to permit well treatment or production without loss of well fluids due to casing corrosion.

One method of casing repair entails cementing plastic or fiberglass casing inside the corroded casing as a liner to restore casing integrity. Such a liner typically extends downwardly to the production zone of interest. In order to produce or inject additional corrosive fluids, a packer suspended from a tubing string must be set inside the plastic casing to prevent further contact of the corrosive elements with the metal casing above the liner. A conventional packer which is set by engaging metal slip teeth against a casing cannot be used to set a packer in a plastic or fiberglass liner.

The instant invention comprises a mandrel having a tubular sleeve slidingly received thereover. Ratchet means are disposed between the sleeve and the mandrel for effecting ratcheting action therebetween in response to movement of the sleeve relative to the mandrel. Piston means slidably mounted on the mandrel adjacent the sleeve is operable to slide the sleeve responsive to annulus pressure.

In one aspect of the invention, an elastomeric packer is disposed about the mandrel adjacent the sleeve and is compressed responsive to movement of the sleeve thereagainst. Another aspect of the invention includes an annular shoulder against which the packer is compressed. The shoulder is threadably engaged with the mandrel by a left-hand thread which enables release of packer compression responsive to right-hand mandrel rotation.

These and other advantages of the instant invention will become more fully apparent when the following detailed description of the preferred embodiment of the invention is read in view of the accompanying drawing wherein:

FIGS. 1A–1B is a quarter section view of a tool constructed in accordance with the instant invention received in a well casing having a plastic liner.

DETAILED DESCRIPTION OF THE PREFERRED EMBODIMENT OF THE INVENTION

Figure 1A:
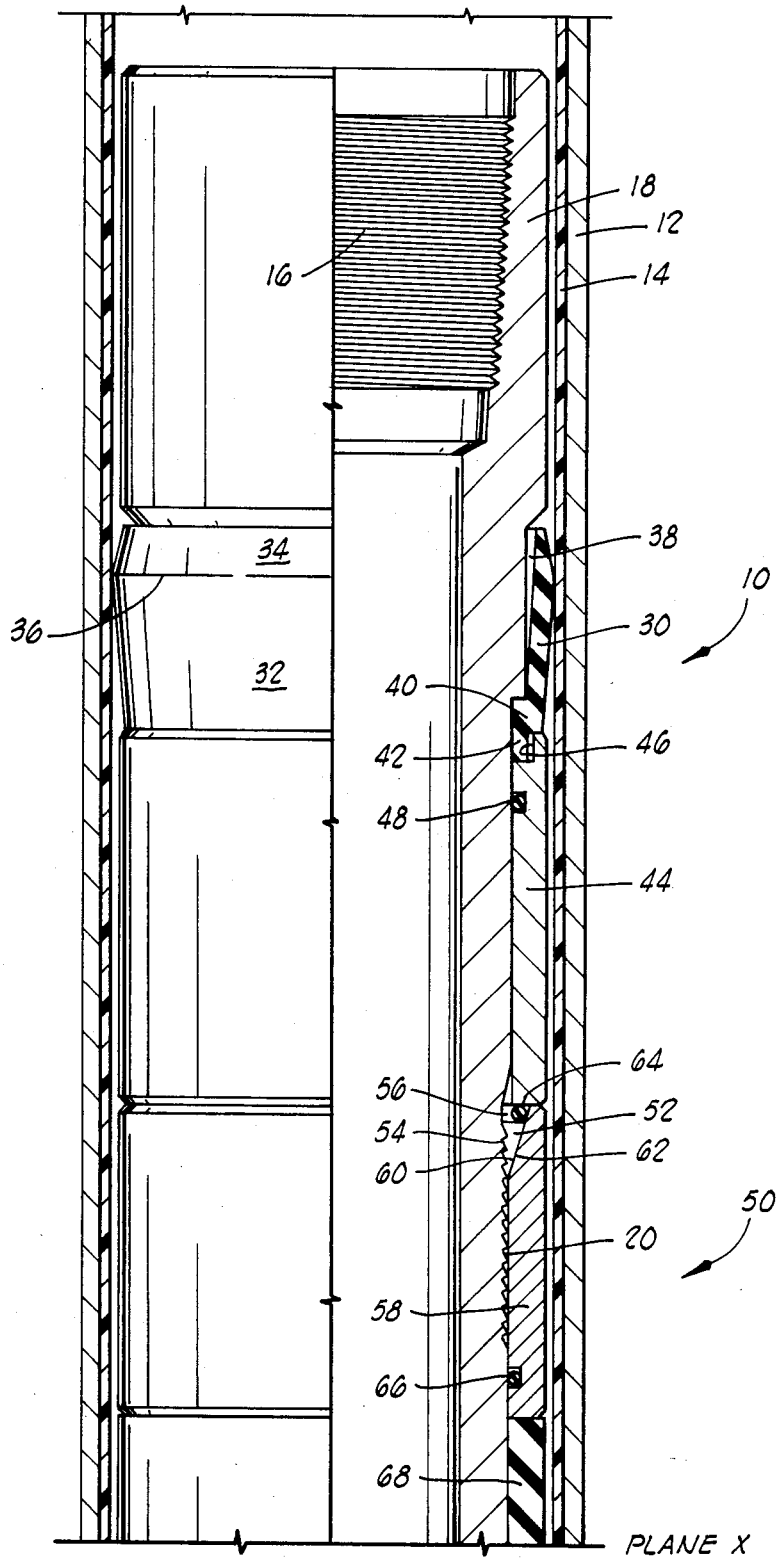
Figure 1B:
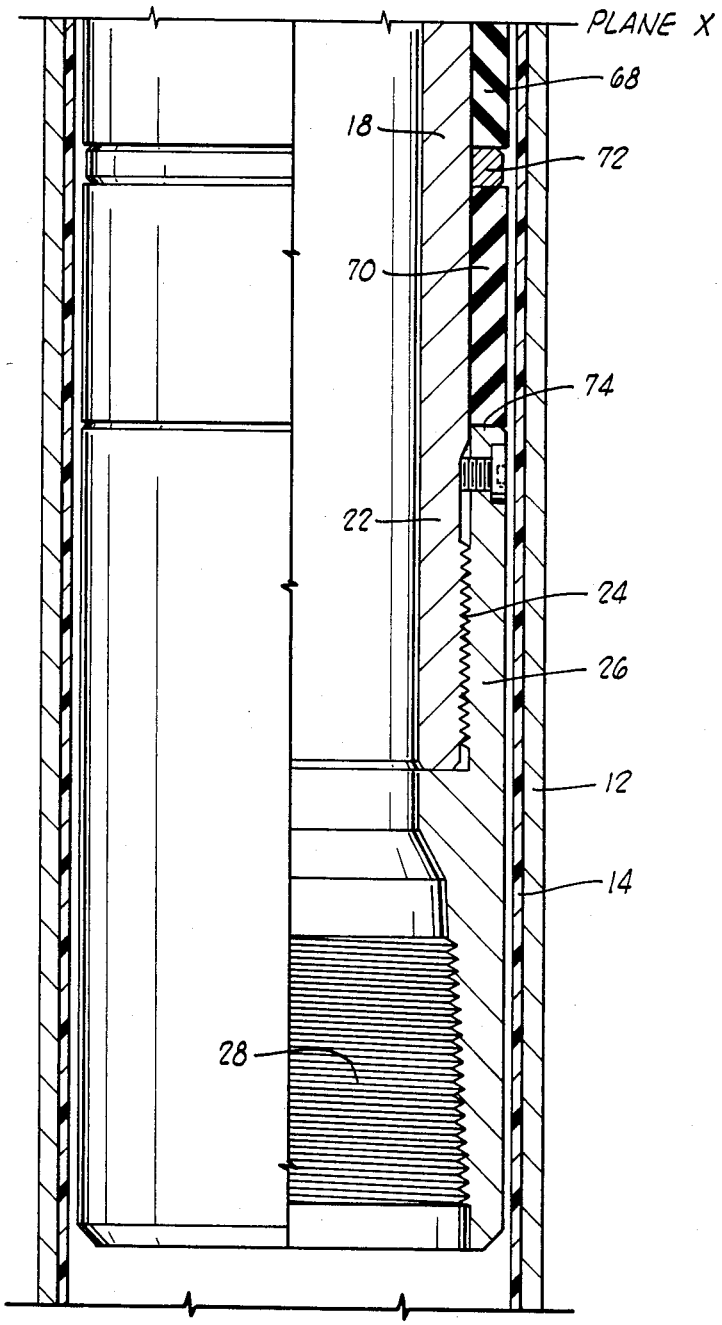

Indicated generally at 10 is a liner packer constructed in accordance with the instant invention. Liner packer 10 is shown suspended in a well casing 12 having a plastic liner 14 cemented therein. Liner packer 10 is suspended in the casing on a tubing string which is threadably engaged to the packer via threads 16 at the top of a mandrel 18. The tubing is not shown in the drawing in order to show all of the structure of packer 10.

Mandrel 18 includes a plurality of downwardly-directed ratchet teeth 20 formed on the surface thereof about its circumference as shown. The mandrel includes a lower end 22 having a threaded connection 24 with a coupling 26. Threaded connection 24 is left-hand threaded. Clock-wise rotation, as viewed down the well bore, threadably disengages mandrel 18 from coupling 26. The coupling includes threads 28 for threadably engaging the lower end of liner packer 10 with a tail pipe if desired.

An annular cup 30, such also being referred to herein as piston means, is received about the circumference of the mandrel as shown. The cup includes a radially outer portion which defines two surfaces 32, 34 that intersect at an apex 36. It can be seen that apex 36 is received against the radially inner surface of plastic liner 14 about the circumference of apex 36 thus sealing the annulus between the mandrel and liner 14 above and below the apex. An annular space 38 is formed between the radially inner surface of cup 30 and the radially outer surface of the mandrel. Cup 30 includes an annular portion 40 which is closely received about the circumference of mandrel 18 and which includes an annular lip 42 at the lower end thereof.

A tubular shoe 44, also referred to herein as abutting means, is closely received about the circumference of mandrel 18 beneath cup 30. An annular space 46 is defined between the upper portion of shoe 44 and mandrel 18 and receives lip 42 therein. An O-ring 48 seals between the radially inner surface of shoe 44 and mandrel 18 about the circumference thereof.

Indicated generally at 50 is ratchet means. Included therein is an arcuate ratchet segment 52 having a plurality of upwardly-directed ratchet teeth 54 formed on the radially inner surface thereof. Segment 52 is one of two segments, the other segment not being visible, which are ratchetably engaged with the downwardly-directed teeth 54 on mandrel 18. Segment 52, as is the other segment, is received in an annular space 56 formed between the upper end of a sleeve 58 and the radially outer surface of mandrel 18. Sleeve 58 includes a tapered surface 60 against which a radially outer tapered surface 62 on segment 52 abuts. The other segment is similarly constructed and includes a tapered surface, like surface 62, which abuts against tapered surface 60 on sleeve 58. An O-ring 64 is supported by the segments. Another O-ring 66 seals between the lower end of sleeve 58 and the mandrel.

A pair of elastomeric sleeves 68, 70, such being also referred to herein as an elastomeric packer or operating element, are received about the circumference of mandrel 18 and are separated from one another by a spacer ring 72. Sleeve 70 is supported by a shoulder 74 formed on the upper end of coupling 26.

In operation, liner packer 10 is suspended from a string of tubing via threads 16 and is lowered into casing 12 until it is received in liner 14. An anchoring device, such as a conventional packer having metal slips with teeth for engaging steel casing, is mounted on the tubing string above liner packer 10 so that when the liner packer is received within liner 14, the conventional packer is above liner 14. Thus, the conventional packer is adjacent steel casing 12.

A typical operation for the above-described tubing string arrangement is injection of some corrosive fluid, for example, carbon dioxide, into the formation. After the tubing string is lowered until the liner packer is positioned as shown in the drawing, the slips on the conventional packer are set against the casing in order to anchor the tubing string, and thus liner packer 10, in position. Although the slips are set, the packer elements are not expanded to seal against the casing.

Annulus pressure is applied at the surface to the fluid in the well bore which is transmitted to cup 30. Pressurized fluid is received within annular space 38 which urges the cup downwardly relative to the mandrel. Such downward movement is transmitted by shoe 44 to sleeve 58 which abut against each other. When sleeve 58 moves downwardly, segment 52 and the other segment tend to also move downwardly under the action of gravity. Additionally, O-ring 64 is compressed by the lower end of shoe 44 against the top of the segments thereby urging the segments downwardly as sleeve 58 moves downwardly.

It can be seen that ratchet teeth 20, 54 prevent upward movement of the segments and that the action of tapered surface 60 against surface 62 of segment 52 prevents upward movement of sleeve 58 relative to the segments.

As sleeve 58 moves downwardly, elastomeric sleeves 68, 70 are compressed between the lower end of sleeve 58 and shoulder 74. Such compression causes sleeves 68, 70 to expand into contact with liner 14 thus sealingly engaging sleeves 68, 70 with the liner. Since ratchet 52 prevents upward movement of sleeve 58, elastomeric sleeves 68, 70 are maintained in their compressed condition.

After sleeves 68, 70 are compressed as described above, the packer rings on the conventional packer which is anchored in the casing above liner 14 are expanded to seal the casing above the liner. Thereafter, when corrosive fluids are injected into the formation via the tubing string, sleeves 68, 70 prevent the corrosive fluid from contacting the steel casing above liner 14 thereby preventing further corrosion. In the event that some of the fluid should migrate upwardly between liner 14 and casing 12, the conventional packer prevents such migrating fluids from being exposed to the casing above the conventional packer.

When it is desired to remove liner packer 10 after it has been set, the liner packer may be simply pulled upwardly to the surface by the tubing string. If necessary, the compression of sleeves 68, 70 may be released as follows. Right-hand rotation, as viewed down the well bore, is applied to the tubing string. With sleeves 68, 70 expanded, coupling 26 remains stationary as mandrel 18 rotates thus unthreading connection 24 and allowing sleeves 68, 70 to relax. The tubing string may then be raised to the surface.

It is to be appreciated that additions and modifications may be made to the preferred embodiment of the invention without departing from the spirit thereof which is defined in the following claims.

We claim:

1. A tubing conveyed, hydraulically set, slipless well packer for sealing a well bore having fluid therein without damage to the well bore or the permanent, plastic deformation of the well bore, said well packer being adapted to be attached to a tubing string to be used in said well bore, said well packer comprising:

a mandrel having one end thereof connected to said tubing string;

an elastomeric packer disposed about said mandrel, said elastomeric packer capable of sealingly engaging said well bore without damage to the well bore or the permanent, plastic deformation of the well bore while anchoring said well packer in said well bore from movement therein;

ratchet means associated with said mandrel adjacent said elastomeric packer for maintaining said elastomeric packer in a compressed condition responsive to activation of said ratchet means wherein said elastomeric packer sealingly engages said well bore without damage to the well bore or the permanent, plastic deformation of the well bore while anchoring said well packer in said well bore from movement therein; and piston means associated with said mandrel and being slidable along the axis thereof responsive to fluid pressure in the annulus between said mandrel connected to said tubing string and the well bore, said ratchet means being activated responsive to such piston means sliding relative to said mandrel to compress said elastomeric packer into sealing engagement with said well bore without damage to the well bore or the permanent, plastic deformation of the well bore while anchoring said well packer in said well bore from movement therein;

whereby said well packer is conveyed into said well bore on said tubing string and is set by increasing the pressure of said fluid in said well bore in the annulus between said mandrel connected to said tubing string and the well bore thereby causing said piston means to move relative to said mandrel to cause said elastomeric packer to sealingly engage said well bore without damage to the well bore or the permanent, plastic deformation of the well bore while anchoring said well packer in said well bore from movement therein, said elastomeric packer being maintained in sealing engagement with said well bore by said ratchet means.

2. The well packer of claim 1 wherein said piston means comprises an annular cup disposed about the circumference of said mandrel above said elastomeric packer.

3. The well packer of claim 2 wherein said apparatus further comprises an annular shoulder disposed about said mandrel adjacent one end of said elastomeric packer and wherein said ratchet means is adjacent the other end of said elastomeric packer.

4. The well packer of claim 3 wherein said annular shoulder is threadedly engaged with said mandrel.

5. The well packer of claim 1 wherein said ratchet means comprises an annular sleeve disposed about said mandrel and having an inwardly tapering surface at the upper end thereof and an arcuate ratchet segment disposed between said inwardly tapered surface and the radially outer surface of said mandrel.

6. The well packer of claim 5 wherein said mandrel includes a plurality of ratchet teeth formed on the radially outer surface thereof and said ratchet segment includes a plurality of ratchet teeth formed on the radially inner surface thereof, said mandrel teeth and said ratchet segment teeth cooperating to effect ratchet action therebetween.

7. The well packer of claim 6 wherein said apparatus further includes means for abutting against the upper end of said annular sleeve for urging said sleeve downwardly.

8. The well packer of claim 7 wherein said ratchet means further comprises a resilient material disposed between said abutting means and said ratchet segment.

* * * * *